US006926319B2

(12) United States Patent
Bates et al.

(10) Patent No.: US 6,926,319 B2
(45) Date of Patent: Aug. 9, 2005

(54) ROSE LOCKING MECHANISM

(75) Inventors: Peter K. Bates, Framingham, MA (US); Thor Hendrickson, London (GB); Dario L. Pompeii, Colorado Springs, CO (US)

(73) Assignee: Schlage Lock Company, Indianapolis, IN (US)

( * ) Notice: Subject to any disclaimer, the term of this patent is extended or adjusted under 35 U.S.C. 154(b) by 0 days.

(21) Appl. No.: 09/792,113

(22) Filed: Feb. 23, 2001

(65) Prior Publication Data

US 2002/0117867 A1 Aug. 29, 2002

(51) Int. Cl.[7] ..... E05B 55/04; E05B 13/10

(52) U.S. Cl. ..... 292/359; 292/DIG. 26; 70/483; 70/150

(58) Field of Search ..... 70/483–485, 150, 70/153; 292/336.3, 336.5, 169.14, 169.15, DIG. 4, DIG. 26, 359

(56) References Cited

U.S. PATENT DOCUMENTS

| | | | | | |
|---|---|---|---|---|---|
| 1,691,528 | A | * | 11/1928 | Schlage | 292/169.16 |
| 1,755,434 | A | * | 4/1930 | Ellingson | 70/476 |
| 2,138,856 | A | * | 12/1938 | Harp | 292/336.3 |
| 2,220,591 | A | * | 11/1940 | Voight | 292/169.16 |
| 2,263,477 | A | * | 11/1941 | Voight | 292/169.16 |
| 2,593,573 | A | * | 4/1952 | Kulbersh | 292/169.16 |
| 2,662,388 | A | * | 12/1953 | Hillgren | 70/481 |
| 2,723,874 | A | * | 11/1955 | Hillgren | 292/336.3 |
| 2,738,666 | A | | 3/1956 | Tornoe | |
| 3,773,370 | A | * | 11/1973 | Jerila | 292/169.21 |
| 3,797,869 | A | * | 3/1974 | Shaw | 292/207 |
| 3,823,585 | A | | 7/1974 | Spon | |
| 3,936,084 | A | * | 2/1976 | Orr | 292/169.15 |
| 4,143,529 | A | * | 3/1979 | Brummett et al. | 292/150 |
| 4,296,956 | A | * | 10/1981 | Colombo | 292/169 |
| 4,615,549 | A | | 10/1986 | Couture | |
| 4,957,315 | A | | 9/1990 | Lin | |
| 4,998,760 | A | | 3/1991 | Nixon et al. | |
| 5,177,987 | A | | 1/1993 | Shen | |
| 5,216,908 | A | | 6/1993 | Malvy | |
| 5,364,139 | A | * | 11/1994 | Bergen et al. | 292/169 |
| 5,484,179 | A | | 1/1996 | Mader | |
| 5,657,653 | A | | 8/1997 | Hensley et al. | |
| 5,816,086 | A | * | 10/1998 | Russell, IV | 292/336.3 |
| 5,941,108 | A | | 8/1999 | Shen | |
| 5,992,189 | A | * | 11/1999 | McCaa | 292/336.3 |
| 6,131,970 | A | * | 10/2000 | Hurst et al. | 292/336.3 |
| 6,216,500 | B1 | * | 4/2001 | Kang | 292/336.3 |
| 6,536,248 | B1 | * | 3/2003 | Fan | 70/467 |

* cited by examiner

*Primary Examiner*—Jack W. Lavinder
(74) *Attorney, Agent, or Firm*—Michael Best & Friedrich LLP

(57) ABSTRACT

A rose locking mechanism developed with a hybrid lock architecture for a door designed to incorporate the functionality of a cylindrical lock architecture with the ease of installation of a tubular lock architecture is provided by the present invention. The hybrid lock architecture comprises a chassis assembly having an inside chassis assembly and an outside chassis assembly that are telescopically engaged to accommodate different door widths. A door latch assembly is operably connected to the chassis assembly for retroaction and extension of a bolt. A handle is mounted on a spindle on either side of the chassis assembly wherein rotational motion imparted on one of the handles is converted to linear motion within the chassis assembly in order to retract the bolt of the door latch assembly. The inside chassis assembly includes a rose locking mechanism positioned radially outward of said inside spindle.

7 Claims, 7 Drawing Sheets

FIG 8
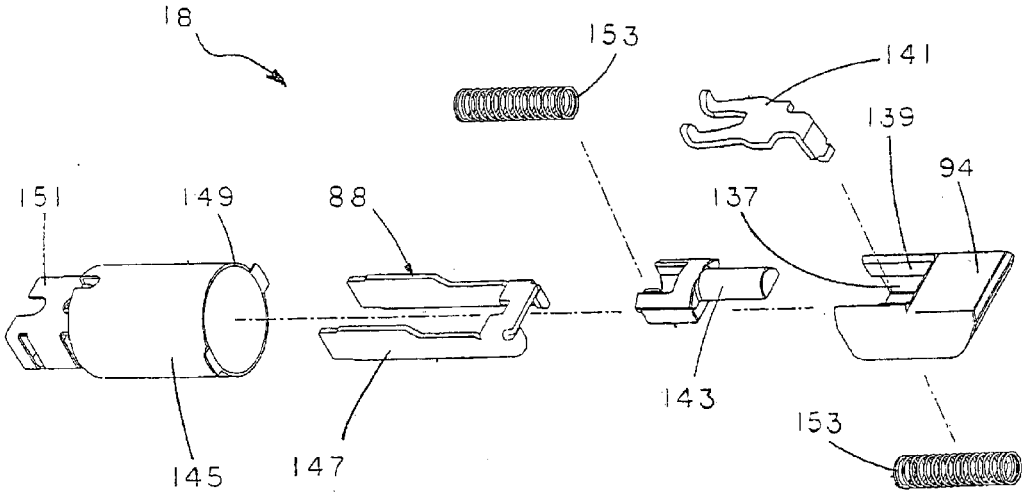
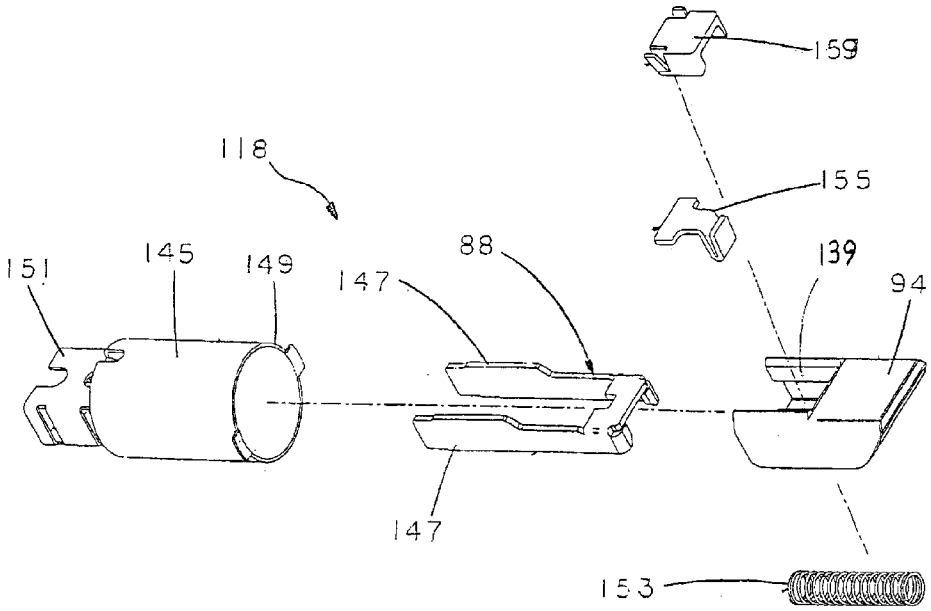
FIG. 9

ROSE LOCKING MECHANISM

TECHNICAL FIELD

This invention relates generally to lock assemblies used to secure doors. More particularly, the present invention relates to a rose locking mechanism for a hybrid lock architecture designed to incorporate the functionality of a cylindrical lock architecture with the ease of installation of a tubular lock architecture.

BACKGROUND OF THE INVENTION

There are currently two main types of lock architectures in widespread use today. These lock architectures are typically known as the cylindrical lock and the tubular lock designs. Each of these designs has advantages and disadvantages in comparison to the other.

While there are variations, traditionally, a cylindrical lock consists of a chassis, an inside mounting plate, an outside mounting plate and rose, an inside rose, a fixed backset latch, an inside and outside knob/lever, and mounting screws. The fundamental workings of the cylindrical lock provide the conversion of rotational motion of the knob/lever to linear motion—within the chassis housing—to retract the latch. The typical cylindrical lock architecture uses a drawbar occupying the axis of the latch bore. The cylindrical lock architecture typically is more expensive to manufacture, but allows more functional variations than a tubular lock and generally provides better security. The chassis has a fixed spindle-end to spindle-end length which easily accommodates a push-button locking mechanism, however this also results in a varying distance from the end of the knob/lever to the surface of the door when used with different door thicknesses. Installation of a cylindrical lock is generally more complicated than that of a tubular lock. During installation of the cylindrical lock, the inside knob/lever, rose, and mounting plate need to be removed. The chassis needs to be centered in the door by adjusting the outside rose. Additionally, the design constraints inherent in the cylindrical architecture make it impossible to have a dual backset latch which does not require some type of adjustment. Where available, these adjustable backsets used in cylindrical locks are failure-prone and inferior to fixed backset latches.

A tubular lock architecture traditionally consists of an inside chassis complete with a rose and a knob/lever attached, an outside chassis also complete with a rose and a knob/lever attached, a latch, and mounting screws. This simple design allows for easy and quick installation of the tubular lock design with virtually no adjustment required. Due to its simplicity, the tubular architecture also provides a cost advantage over the cylindrical lock. The tubular lock design also provides a fixed distance from the surface of the door to the end of the lever even when used with different door thicknesses. The tubular lock architecture converts rotational motion of the knob/lever to linear motion within the latch in order to retract the latch. Accordingly, a drawbar occupies the axis of the latch bore. However, due to the edge bore of a door preparation, the amount of latch retraction is restricted. In addition, rose locking mechanisms used in a tubular lock utilize a moveable locking mechanism located in the latch to lock the door. Other problems are found in that design constraints make it impossible to design a consistently functioning push button lock because of the chassis datum on the surface of the door. Since the door thickness variation is considerably greater than the push button linear travel, no direct means are available to provide a secure consistent locking action. The tubular lock architecture is also generally less secure than a cylindrical lock architecture.

Accordingly, there remains a need in the art for a lock architecture which combines the advantages of both the tubular lock architecture and the cylindrical lock architecture along with other advantages, while minimizing or removing the limitations existing in each of the prior art designs. Accordingly, a suitable alternative is provided including features more fully disclosed hereinafter.

SUMMARY OF THE INVENTION

It is therefore an object of the present invention to provide a new lock architecture configuration designed to incorporate the functionality of a cylindrical lock architecture with the ease of installation of a tubular lock architecture and specifically incorporating a rose locking mechanism. These and other improvements are provided by a lock assembly for a door comprising a chassis assembly mounted in a bore of the door including an inside chassis assembly and an outside chassis assembly. The inside chassis assembly and the outside chassis assembly are telescopically engaged to accommodate different door widths. A door latch assembly is operably connected to the chassis assembly for retraction and extension of a bolt. A handle is mounted on a spindle on either side of the chassis assembly wherein rotational motion imparted on one of the handles is converted to linear motion within the chassis assembly in order to retract the bolt of the door latch assembly. The inside chassis assembly includes a rose locking mechanism positioned radially outward of said inside spindle.

BRIEF DESCRIPTION OF THE DRAWINGS

FIG. 8 is an exploded perspective view of a dead latch assembly of an embodiment of the lock architecture of the present invention as shown in FIG. 1; and FIG. 9 is an exploded perspective view of a spring latch assembly of an embodiment of the lock architecture of the present invention as shown in FIG. 1 also showing the optional restore mechanism of another embodiment of the present invention.

DETAILED DESCRIPTION OF THE DRAWINGS

Figure 1:
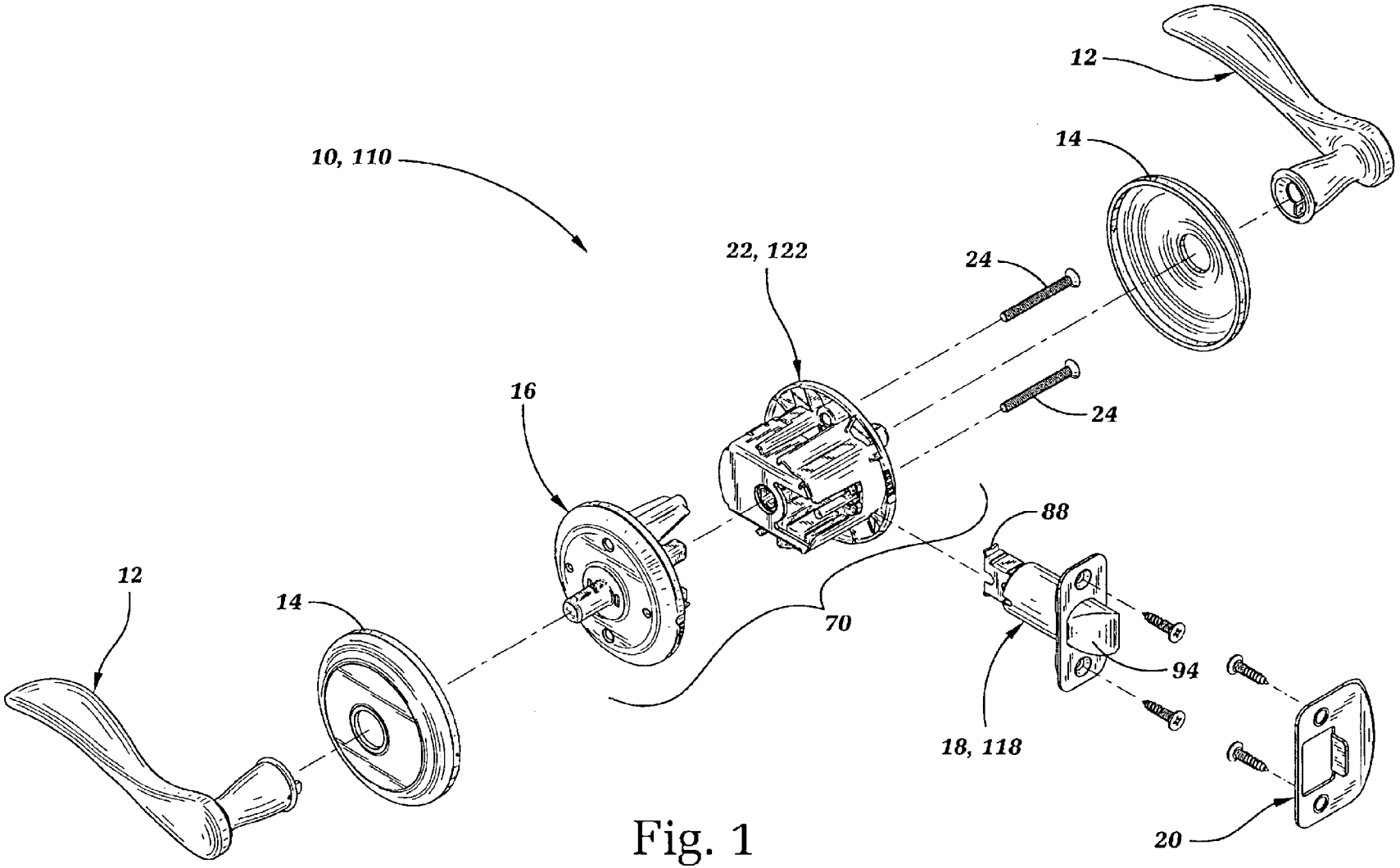
FIG. 1 is an exploded perspective view of a hybrid lock architecture including the rose locking mechanism of the present invention.

Referring now to the drawings, wherein similar reference characters designate corresponding parts throughout the several views, there is generally indicated at 10 a hybrid lock architecture incorporating the rose locking feature of the present invention. The hybrid lock architecture 10 is also referred to and comprises the hybrid lock architecture without the rose locking feature. As shown in FIG. 1, the hybrid lock architecture 10 comprises an outside chassis assembly 16, a latch assembly 18, a strike plate assembly 20, an inside chassis assembly 22, mounting screws 24, door handles or knob/lever assemblies 12, and roses 14. These pre-assembled components provide simple "hands off" assembly of the hybrid lock 10 in a prepared door similar to a tubular lock assembly. In addition, the hybrid lock 10 also has a fixed distance from the handle to the door as in the tubular lock assembly. The hybrid lock architecture 10 is versatile and can accommodate various other features in place of or in addition to a rose locking feature such as an axial push button locking mechanism, a dual backset latch attachment, and/or a key cylinder assembly, as well as various field modifications, some of which are discussed in detail below. The hybrid lock architecture 10 also uses standard base parts across multiple configurations which enables lower production costs of the multiple configurations, providing a cost effective design.

Figure 2:
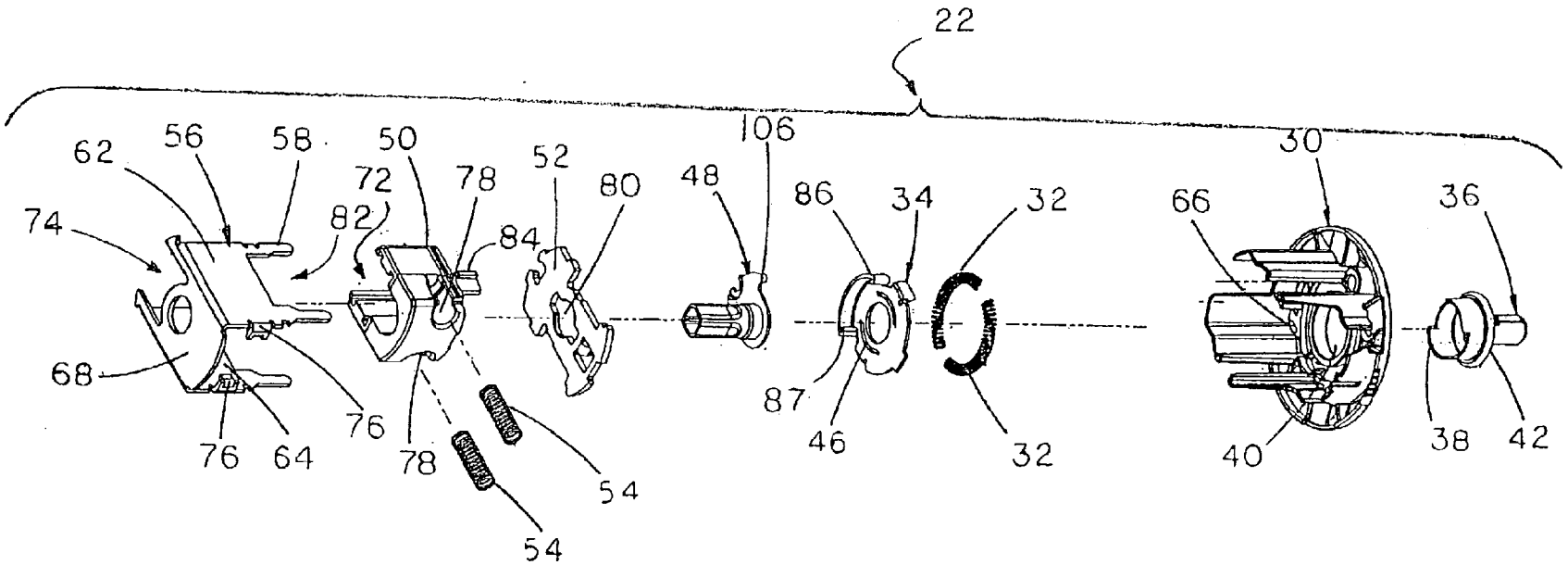
FIG. 2 is an exploded perspective view of the inside chassis assembly of the lock architecture shown in FIG. 1 without the rose locking feature.

The details of each component assembly will now be discussed in detail. Referring now to FIG. 2, hybrid lock architecture 10 comprises inside chassis assembly 22 which is shown in an exploded manner. Inside chassis assembly 22 comprises an inside housing 30 which mates against the inside surface of the door, not shown, and fits into a bore in the door. At least one lever spring 32 is held in place against inside housing 30 by a main retractor 34. In the embodiment shown, two lever springs 32 are shown which, in conjunction with the main retractor 34, are secured to the inside housing 30 by stepped spindle 36. Stepped spindle 36 comprises at least one flanged portion 38 which extends through a centrally located aperture 40 of inside housing 30 and a flange portion which registers against the exterior surface 44 of inside housing 30. The at least one flanged portion 38 of stepped spindle 36 extends through a mating slot 46 in main retractor 34 and is staked in a manner securing the attached parts. Any suitable attachment is contemplated such as a retaining ring, welding, adhesive, 20 etc. Other suitable configurations to attach stepped spindle 36 to main retractor are contemplated. The stepped spindle 36 is rotatable within inside housing 30, however lever springs 32 are positioned with one end biased against inside housing 30 and the other end biased against main retractor 34 such that the stepped spindle 36 will return to a neutral position when a restraining force is removed, such as a user letting go of the lever/knob assembly 12.

Inside chassis assembly 22 further comprises an inner retractor 48, locking plate 52, slide 50, and at least one slide spring 54, all of which are attached to inside housing 30 by a slide cage 56. Slide cage 56 may be attached to inside housing 30 by tangs 58 extending from a first cage surface 62 and from a second cage surface 64. The tangs 58 are insertable into mating slots 66 formed in inside housing 30. Other forms of attachment between the slide cage 56 and inside housing 30 are also contemplated and within the scope of the to invention. In the embodiment shown, upper or first cage surface 62 and lower or second cage side 64 are generally parallel to each other and connected by a generally U-shaped body portion 68 which is generally perpendicular to the first and second cage sides 62 and 64. Slide 50 is generally U-shaped and slidably fits within cage 56. Slide 50 is oriented within cage 56 such that an open end 72 of slide 50 is oriented in the same direction as an open end 74 of body portion 68. Slide springs 54 axe mounted on spring guide tabs 76 extending toward each other and perpendicularly from each cage side 62, 64. In an assembled configuration, slide springs 54 mate with self retaining springs seats 78 formed within slide 50 in a manner biasing the slide 50 toward the open end 74 of cage 56.

Figure 3:
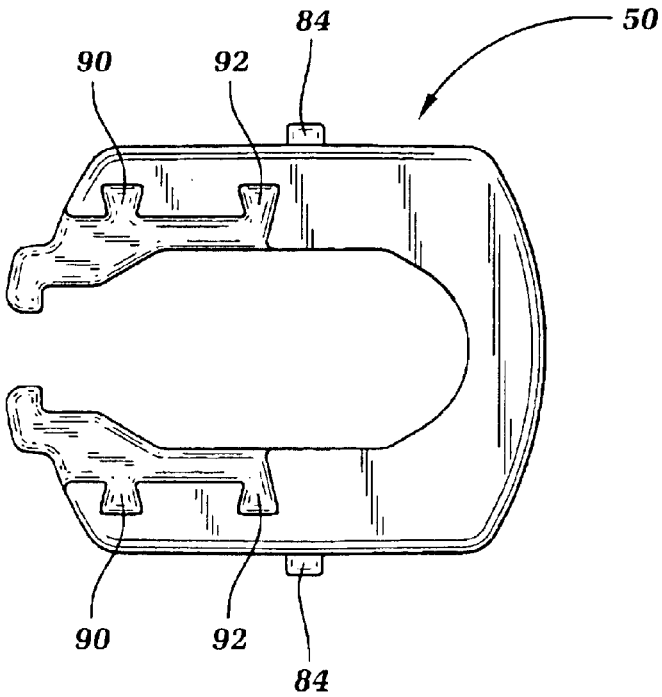
FIG. 3 is a side elevational view of the slide element of the inside chassis assembly as shown in FIG. 2.
Figure 4:
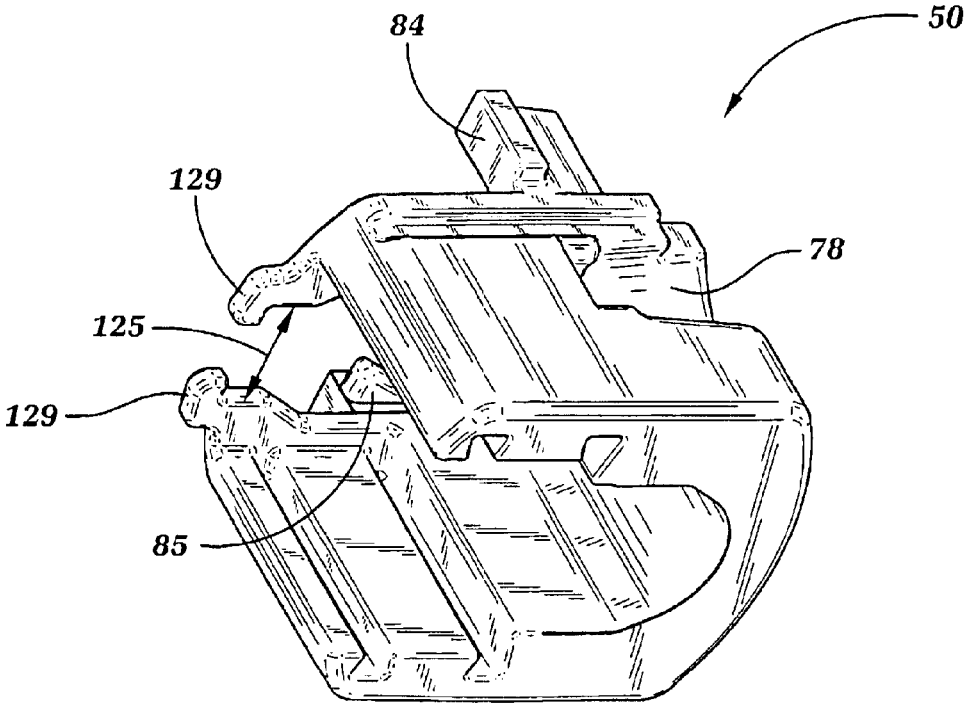
FIG. 4 is a perspective view of the slide element of the inside chassis assembly as shown in FIG. 2.

Lock plate 52 rotatingly mates with inner retractor 48 which is positioned through an aperture 80 in lock plate 52. The assembled lock plate 52 and inner retractor 48 are positioned over slide 50 positioned within cage 56 on a tanged side 82 of slide cage 56. In the assembled configuration, lock plate 52 is generally parallel to U-shaped cage body portion 68 and generally perpendicular to upper and lower cage sides 62 and 64, respectively. Referring to FIGS. 3 and 4, slide 50 has retractor extensions 84 extending therefrom which are positioned within a raised arcuate portion 86 of main retractor 34. The arcuate portion 86 has ends 87 which engage extensions 84 upon rotation of main retractor 34 in either direction, thereby causing slide 50 to slide away from the open end 74 of U-shaped body portion 68 of cage 56. Referring to FIGS. 1 and 3–5, latch assembly 18 includes a drawbar 88 which mates within a first pair of slots 90, or a second pair of slots 92. Thus, rotational motion of the knob/lever assembly 12, causing rotation of main retractor 34, is converted to lateral movement of the slide 50. Lateral movement of the slide 50 results in retraction of a bolt 94 attached to the drawbar 88 of latch assembly 18. Conversely, when the rotational force on the main retractor 34 is released, springs 32 cause the main retractor 34 to return to its original position which allow slide springs 54 bias slide 50 towards the open end 74 of cage 56. This enables the spring biased drawbar to return to an extended position, in turn causing bolt 94 to return to an extended or latched position.

Figure 5:
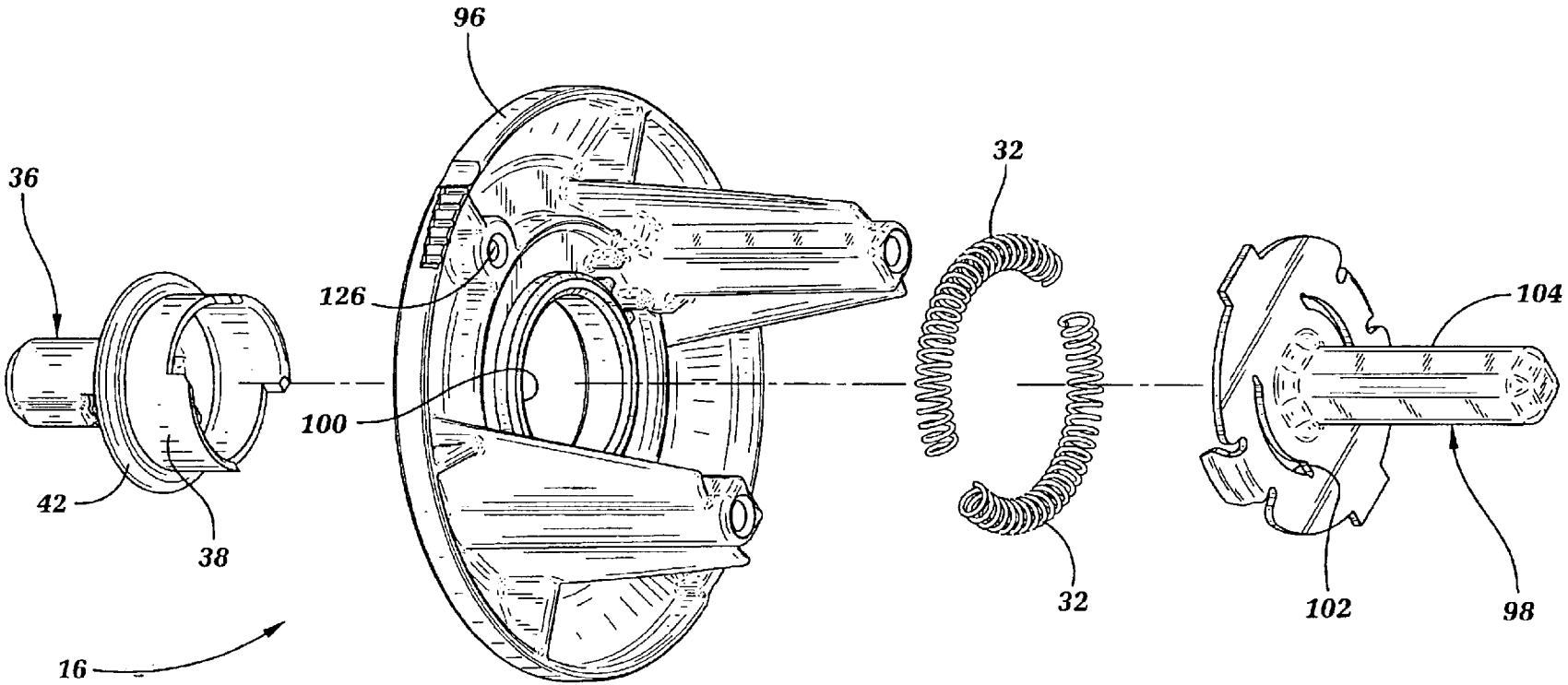
FIG. 5 is an exploded perspective view of the outside chassis assembly of an embodiment of the lock architecture of the present invention as shown in FIG. 1.

Outside chassis assembly 16 is shown in more detail in FIG. 5. Similarly to inside chassis assembly 22, outside chassis assembly 16 comprises an outside housing 96 which mates against the outside surface of the door, not shown, and fits into a bore in the door, and at least one lever spring 32, held in place against the outside housing 96 by inner retractor driver 98. The lever springs 32 and inner retractor driver 98 are secured to the outside housing 96 by stepped spindle 36. Stepped spindle 36 may comprise at least one tanged portion 38 which extends through a centrally located aperture 100 of outside housing 96 and a flange portion 42 which registers against the outer surface of outside housing 96. The at least one tanged portion 38 of stepped spindle 36 extends through a mating slot 102 in inner retractor driver 98 and is staked in a manner securing the attached parts. Any suitable attachment is contemplated such as a retaining ring, welding, adhesive, etc. Again, other suitable configurations to attach the spindle 36 to the driver 98 are contemplated. The spindle 36 is rotatable within outside housing 96, however lever springs 32 are positioned with one end biased against outside housing 96 and the other end biased against inner retractor driver 98 such that the spindle 36 will return to a neutral position when a restraining force is removed, such as a user letting go of the lever/knob assembly 12. The inner retractor driver 98 includes a driver bar portion 104. When outside chassis assembly 16 is attached to inside chassis assembly 22, driver bar portion 104 of inner retractor driver 98 mates within inner retractor 48 such that rotation of one causes rotation of the other. As previously described, slide 50 has retractor extensions 84 extending therefrom which are biased against a retractor portion 106 of inner retractor 48. Rotation of inner retractor 48 in either direction causes slide 50 to slide away from the open end 74 of U-shaped body portion 68 of cage 56, thus retracting bolt 94 attached to the drawbar 88 of latch assembly 18. Conversely, when the rotational force on the inner retractor 48 is released, springs 32 cause the inner retractor 48 and inner retractor driver 98 to return to their original positions which allow slide springs 54 to bias slide 50 towards the open end 74 of cage 56. This enables the bolt 94 to return to an extended or latched position.

When lock architecture 10 is used on non-standard thickness doors, either thinner or thicker, outside chassis assembly 16 can move inward or outward in relation to inside chassis assembly 22 as driver bar portion 104 of inner retractor driver 98 is able to slide inward or outward in a telescopic manner with respect to inner retractor 48 and still maintain a co-rotating connection with inner retractor 48. This makes any adjustment of the lock unnecessary. Conversely, a cylindrical architecture lock chassis has a fixed spindle-end to spindle-end length which results in a varying distance from the end of the lever to the surface of the door when used with different door thicknesses. The combination of inside chassis assembly 22 and outside chassis assembly 16 form lock architecture chassis assembly 70. Accordingly, with lock architecture 10, the distance between the door handle 12 and the door (not shown) will always be fixed distance regardless of variations in the door thicknesses.

Focusing now on FIGS. 3 and 4, slide 50 will be discussed in greater detail. Slide 50 provides the conversion of rotational movement into lateral movement of the drawbar 88 through the unique configuration of the cam surfaces of slide body 50. Slide 50 comprises dual, co-planar independent retractor extensions 84. This allows slide 50 to react to rotation of main retractor 34 or inner retractor 48 in either a clockwise or counter-clockwise direction. Slide 50 comprises self-retaining spring seats 78 which allow for easy assembly of the slide 50 within cage 56. The U-shaped body configuration of slide 50 also allows clearance throughout its stroke for associated parts to occupy the central rotational axis between the lever/knob assemblies 12 of lock architecture 10. Another aspect of slide 50 are two pairs of interlocking drawbar retaining members, such as slots 90, 92 which allow a dual backset feature. Although slots 90, 92 are shown in the embodiment, other suitable retaining members are contemplated, such as mechanical fasteners or the like. This enables latch assembly 18 to be attached to accommodate different standard backset distances such that no adjustment is required. A dual backset feature also enables slide 50 to be used with a convertible latch assembly 18 which will be discussed in detail below.

Figure 6:
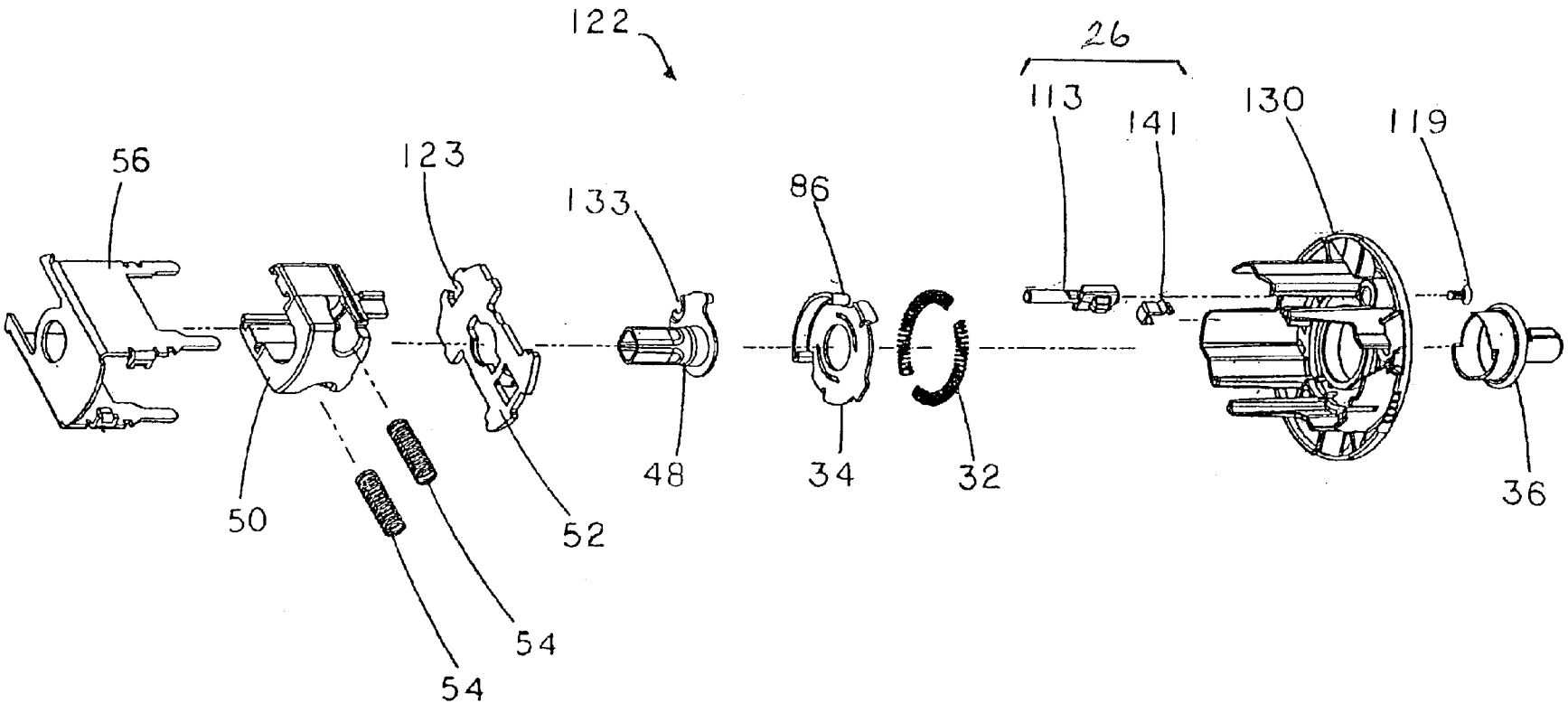
FIG. 6 is an exploded perspective view of an embodiment of the rose locking feature of the present invention incorporated in the inside chassis assembly of FIG. 2.
Figure 7:
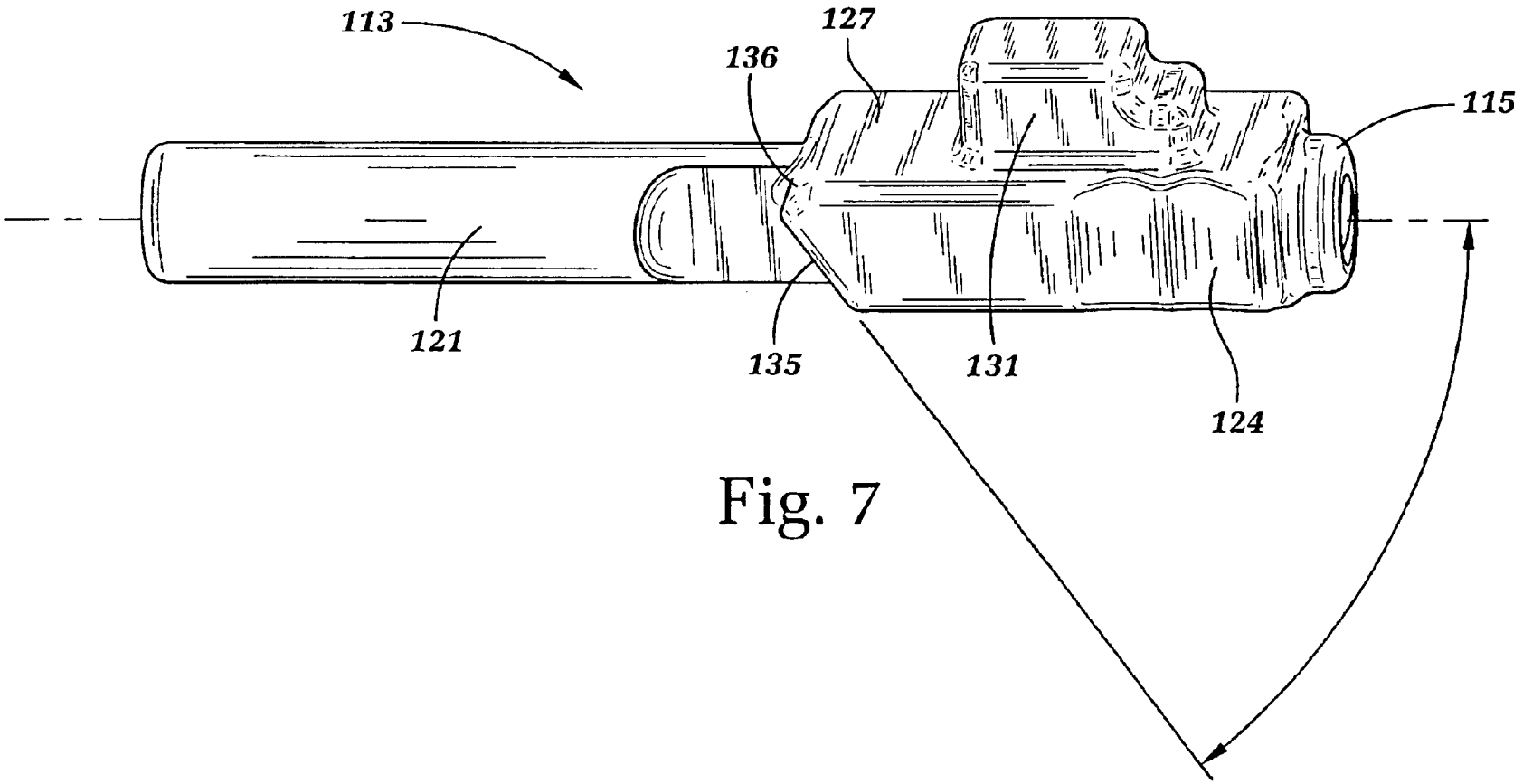
FIG. 7 is a perspective view of a push button lock bar used in the rose locking feature embodiment of the present invention as shown in FIG. 6.

Lock architecture 10 was shown in a passage function configuration whereas rotation of door handle 12 from either the inside of the door or the outside of the door would retract the bolt 94 and open the door. In a locking embodiment, lock architecture 110 provides a privacy configuration that comprises an inside chassis assembly 122 including a rose locking mechanism 26 as shown in FIG. 6. Inside chassis assembly 122 is similar to inside chassis assembly 22 except that it further comprises rose locking feature 26 including a push button lock bar 113, shown in detail in FIG. 7, having a first end 115 which protrudes through an aperture 117 (not shown) in inside housing 130. Rose locking mechanism 26 of inside chassis assembly 122 also comprises a rose lock catch 141 which biasly engages one of a pair of depressions 124 located on intermediate portion 127 of push button lock bar 113 holding it in a selected position in either a locked or unlocked axial position. Rose lock catch 141 is held in place by being captured between inside housing 130 and lock plate 52. The first end 115 of push button lock bar 113 is internally threaded and mates with an externally threaded decorative stem attached from the opposite side of inside housing 130. Second end 121 of push button lock bar 113 is generally formed as a rod which, when lock architecture 110 is assembled, extends through an opening 123 in lock plate 52 and a similarly configured opening 125 in slide 50 in a manner allowing slide 50 to move freely within cage 56. Push button lock bar 113 includes an intermediate locking portion 127 between first end 115 and second end 121. Push button lock bar 113 is held in place by intermediate locking portion 127 being captured between inside housing 130 and lock plate 52. Slide 50 includes two converging extensions 129, also referred to as push button lock bar retractors, on open end 72 as seen in FIG. 4. When a rose locking button (not shown) is depressed toward inside housing, push button lock bar 113 moves axially such that intermediate locking portion 127 engages slide 50 such that converging extensions 129 contact intermediate locking portion 127. Intermediate portion 127 includes an extension portion 131 which, when the rose locking feature is engaged, axially engages a slot 133 in inner retractor 48 in a manner preventing rotational movement of inner retractor 48, thus preventing the lock 110 from being operated from the outside of the door. Conversely, prior art rose locking features used in tubular locks utilize a moveable locking mechanism located in the latch to lock the door.

The rose locking mechanism 26 can be disengaged in several ways. The first method is by rotation of the inside door lever/knob 12 which rotates main retractor 34. The arcuate portion 86 of main retractor 34 engages extensions 84 on slide 50. Intermediate locking portion 127, as previously mentioned, engages slide 50. However, intermediate locking portion 127 has a first inclined leading cam surface 135 on the side adjacent converging extensions 129 of slide 50. As the slide 50 moves due to rotation of main retractor 34, converging extensions 129 engage first inclined leading cam surface 135 forcing push button lock bar 131 axially into an unlocked position. The second method of disengaging the rose locking feature 26 is by pushing a rod through an aperture 126 in the outside housing 96 and manually disengaging the push button lock bar 113 similar to that of a conventional cylindrical lock with a central push button locking mechanism. A third method is provided when the door is open when the rose locking mechanism 26 is engaged, closing the door will unlock the door when the lock is configured with a restoring feature (to be discussed in detail below). Essentially, when the door bolt hits the strike plate assembly 20, the latch assembly 18 forces the slide 50 to move. As the slide 50 moves, converging extensions 129 engage first inclined leading cam surface 135 forcing push button lock bar 131 axially into an unlocked position. Conversely, if a restoring feature is not used in the latch assembly 18, the door will remain locked when shut after engaging the rose locking feature 26. As can be seen, the rose locking mechanism 26 is completely contained in the inside chassis assembly 122. The rose locking feature does not depend on the distance between the inside chassis assembly 122 and the outside chassis assembly 16. Lock architecture 110 therefore provides the convenience of a rose locking mechanism 26 which is independent of varying door thicknesses and varying distances between door lever/knobs 12.

It is possible to accidentally engage push lock bar 113 into a locked position when the slide 50 is in a retracted bolt position. In such a case, push lock bar 113 will be automatically returned to a disengaged position when slide 50 returns to an extended bolt position toward the U end 74 of cage 56. This is accomplished by converging extensions 129 of slide 50 engaging a second inclined leading cam surface 136 on intermediate portion 127 of push lock bar 113. As converging extensions 129 engage second cam surface 136, push lock bar 113 is forced rearward to a disengaged position.

Another aspect of the present invention involves a convertible door latch assembly for use in both a non-locking function lock architecture and a privacy, or locking lock architecture configuration. The convertible door latch assembly can easily be converted from a dead latch configuration to a spring latch configuration. Each configuration can also be converted from a non-restoring to a restoring function. Referring now to FIG. 8, door latch assembly 18 is shown in an exploded manner in a dead latch configuration. Latch assembly 18 comprises bolt 94, and drawbar 88 slidably captured within a first slot 137 of bolt 94 by dead latch stop 141. A plunger 143 slidably positioned partially within a second slot 139 of bolt 94 is provided, along with a bolt housing 145. Drawbar 88 may be U-shaped having legs 147. The U-shaped drawbar 88 allows greater latch retraction while providing clearance for other lock architecture assembly components. Bolt housing 145 has a first end 149 and a second end 151. The bolt 94/drawbar 88/dead latch stop 141/plunger 143 combination is attached to bolt housing 145 by inserting the drawbar legs 147 through first end 149 of bolt housing 145 until they extend beyond the second end 151 of bolt housing 145 and bending drawbar legs 147 outward. The bolt 94/drawbar 88 is biased by spring 153 into an extended position such that a portion of bolt 94 extends out of bolt housing 145. The plunger 143 is biased by spring 153 into an extended position such that a portion of plunger 143 extends out of bolt housing 145. Dead latch assembly 18 eliminates the typical dead latch stop, which is fixed to the stationary bolt housing, and replaces it with dead latch stop 141, which acts as a dynamic link between drawbar 88 and bolt 94. When the dead latch plunger 143 is depressed, the dead latch stop 141 engages the bolt housing 145 preventing the bolt 94 from being depressed. When the drawbar 88 is activated by the slide 50 in the lock chassis, the interface of the drawbar 88 and dead latch stop 141 causes the dead latch stop 141 to swing away from the stationary bolt housing 145 allowing the retraction of the bolt 94.

Referring now to FIG. 9, door latch assembly 118 is shown in an exploded manner in a spring latch configuration. Latch assembly 118 comprises a bolt 94, a drawbar 88 slidably captured within a slot 139 of bolt 94 by pull 153, and a bolt housing 145. The bolt 94/drawbar 88/pull 153 combination is attached to bolt housing 145 by inserting the drawbar legs 147 through first end 149 of bolt housing 145 until they extend beyond the second end 151 of bolt housing 145 and bending drawbar legs 147 outward. The bolt 94/drawbar 88 is biased by spring 153 into an extended position such that a portion of bolt 94 extends out of bolt housing 145 in a standard manner. Door latch 118 is easily converted from a spring latch 18 to a dead latch 18 in the manufacturing process or in the field by disassembling the latch assembly 118 and replacing pull 155 with dead latch stop 141 and adding plunger 143 and spring 153. Conversely, door latch assembly 18 is easily converted from a dead latch 18 to a spring latch 118 in the manufacturing process or in the field by disassembling the latch assembly 118 and replacing dead latch stop 141 with pull 155 and removing plunger 143 and plunger spring 153.

In both door latch assemblies, 18, 118, depressing the bolt will not result to in movement of drawbar 88 as both door latch assemblies are in a non-restoring configuration. In other words, when an open door is locked (e.g., when shut), the door will remain in a locked state. In another embodiment, the present invention provides an inactive component referred to as a restore component 159 as shown in FIG. 9 to convert the latch from a non-restoring configuration to a restoring configuration. The restore component 159 is also easily removed to convert the latch from a restoring configuration to a non-restoring configuration. Restore component 159 is positioned within slot 139 and is of such physical dimension that restore component 159 restricts the movement of drawbar 88 within slot 139. When door latch assembly 18, 118, are configured with restore component 159, depressing the bolt 94 results in movement of drawbar 88. This action causes slide 50 to move and, if the door is in a locked state, with causes the door to unlock.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A rose locking mechanism for use in a lock assembly attached to a door comprising:

a lock assembly comprising a chassis assembly having a slide linearly displaceable between retracted and extended positions and a rotatable member, the rotatable member being directly engageable with the slide such that rotation of the member displaces the slide between the retracted and extended positions, a latch assembly operably connected to the slide for retraction and extension of a bolt such that slide displaces the latch assembly to displace the bolt when the rotatable member displaces the slide, an inside handle operably connected to said chassis assembly, an outside handle operably connected to said chassis assembly, and an inside rose attached to said chassis assembly; and a push lock bar having an intermediate portion between a first and a second end, the intermediate portion being engageable with the rotatable member so as to prevent rotation of the outside handle, wherein said first end protrudes at least partially through said inside rose, wherein said intermediate portion is captured within said chassis assembly, and wherein said intermediate portion includes a first cam portion engageable by the slide such that when the slide moves from the extended position to the retracted position, the slide pushes the lock bar to displace axially so as to disengage the intermediate portion from the rotatable member, said axial motion of said push lock bar being perpendicular to a direction of said linear motion of said slide, and a second cam portion which enables linear motion along an axis of a door latch to be converted into axial motion of said push bar from a locked position when said push lock bar is depressed while the bolt is retracted.

2. The rose locking mechanism of claim 1 further comprising a rose lock catch component which engages one of a plurality of depressions on said push lock bar to retain said push lock bar in a selected axial position within said chassis assembly.

3. The rose locking mechanism of claim 1, wherein rotation of said inside handle of said chassis assembly causes said push lock bar to move axially from a locked position to an unlocked position and causes retraction of said bolt.

4. The rose locking mechanism of claim 1, wherein said chassis assembly includes an aperture allowing access for manually moving said push lock bar from a locked position to an unlocked position.

5. The rose locking mechanism of claim 1, wherein said door latch assembly comprises a restore member such that depression of said bolt disengages said rose locking mechanism from a locked position to an unlocked position.

6. A rose locking mechanism for use in a lock assembly attached to a door, the lock assembly including a displaceable slide configured to alternatively retract and extend a latch bolt, the locking mechanism comprising:

a push lock bar having an intermediate portion between a first and a second end, wherein said first end protrudes at least partially through an inside rose of said lock assembly, wherein said intermediate portion is captured within a chassis assembly of said lock assembly, wherein said intermediate portion includes a first cam portion engageable by the slide such that when the slide moves from the extended position to the retracted position, the slide pushes the lock bar to displace axially, the axial motion of said push lock bar being perpendicular to a direction of said linear motion of said slide; and wherein said intermediate portion of said push locking bar includes a second cam portion which enables linear motion along an axis of a door latch to be converted into axial motion of said push bar from a locked position when said push lock bar is depressed while the bolt is retracted.

7. The rose locking mechanism of claim 6 further comprising a push lock bar catch component biasing said push lock bar in a selected axial position within said lock assembly.

* * * * *